US006094845A

United States Patent [19]

Lela

[11] Patent Number: 6,094,845

[45] Date of Patent: Aug. 1, 2000

[54] SNOW-HANDLING TRAIL-GROOMING DEVICE

[76] Inventor: Gary J. Lela, 204 N. Richmond Ave., Westmont, Ill. 60559

[21] Appl. No.: 09/073,777

[22] Filed: May 6, 1998

Related U.S. Application Data

[63] Continuation-in-part of application No. 08/852,832, May 7, 1997.

[51] Int. Cl.[7] ..... A63C 19/10

[52] U.S. Cl. ..... 37/219; 37/232; 172/684.5; 172/393; 172/613

[58] Field of Search ..... 172/146, 684.5, 172/387, 392, 393, 613, 619, 623, 738; 280/20, 142; 37/219, 221, 232, 233, 270, 196

[56] References Cited

U.S. PATENT DOCUMENTS

| | | | |
|---|---|---|---|
| 3,106,969 | 10/1963 | Carter | 172/197 |
| 3,478,827 | 11/1969 | Madson | 172/379 |
| 3,576,214 | 4/1971 | Ratcliffe | 172/393 |
| 3,666,020 | 5/1972 | Hess | 172/612 |
| 3,687,344 | 8/1972 | Nixon | 224/29 R |
| 3,741,577 | 6/1973 | Rude | 280/18 |
| 3,779,572 | 12/1973 | Cheney | 280/21 R |
| 3,795,069 | 3/1974 | Cheney | 37/48 |
| 3,872,931 | 3/1975 | Camp | 173/387 |
| 3,878,900 | 4/1975 | Boisse et al. | 172/145 |
| 3,915,239 | 10/1975 | Hendrichon | 172/146 |
| 4,058,913 | 11/1977 | Esquilat | 37/50 |
| 4,070,030 | 1/1978 | Clark | 280/24 |
| 4,110,919 | 9/1978 | Henrichon | 172/188 X |
| 4,122,614 | 10/1978 | Cheney | 172/394 X |
| 4,244,662 | 1/1981 | Olson | 404/118 |
| 4,337,586 | 7/1982 | Buono | 172/145 X |
| 5,119,752 | 6/1992 | Doherty | 114/270 |
| 5,680,715 | 10/1997 | Thiboutot et al. | 37/268 X |

*Primary Examiner*—Victor Batson
*Attorney, Agent, or Firm*—Heslin & Rothenberg, P.C.

[57] ABSTRACT

This invention concerns a snow-handling trail-grooming device. The invention comprises a sled including at least one runner member, a sled front end, a sled back end and an open-ended longitudinal cavity therethrough open at opposed longitudinal ends thereof. The sled is connectable to a snowmobile by a towing or hitching member joined with the sled for hitching and unhitching the sled to and from the snowmobile. A tunnel structure is joined with the runner member and positioned over the open-ended longitudinal cavity. Finally, a handling-grooming member can be joined with the runner member, wherein the handling-grooming member is positioned in an extended direction away from the tunnel structure during snow-handling and trail-grooming.

12 Claims, 6 Drawing Sheets

SNOW-HANDLING TRAIL-GROOMING DEVICE

PRIOR RELATED APPLICATION

This application is a continuation-in-part of prior U.S. application Ser. No. 08/852,832, filed May 7, 1997, which application is incorporated fully herein by reference.

FIELD OF THE INVENTION

The present invention relates generally to a snow trail grooming device for use with a snowmobile. More specifically. my invention relates to a recreational Snow-Handling Trail-Grooming Device for use with an operating snowmobile or similar vehicle to prevent moguls, mounds of snow and the like from forming and to aid in smoothing a snow trail affected by existing moguls, mounds of snow and the like.

BACKGROUND OF THE INVENTION

Various towable ground leveling devices exist in the prior art, such as U.S. Pat. Nos. 3,795,069 and 3,106,969. Also, there are several towable sled type devices for use with personal motorcraft, including a snowmobile and the like, namely, U.S. Pat. Nos. 5,119,752 and 3,741,577. Finally, the prior art also includes various towable devices specifically directed to snow grooming/leveling, such as those seen in U.S. Pat. Nos. 4,244,662, 3,915,239 and 3,478,827, and 3,872,931, 3,666,020 and 3,576,214. Of these, only the later three are nonindustrial type devices intended and able to be towed behind a snowmobile under operating conditions, i.e., at all speeds while traveling over a snowmobile trail.

Several disadvantages exist in these devices based on the devices themselves as well as the basic operating characteristics of a snowmobile. As is appreciated by one in this art and moreover the average snowmobile operator, most snowmobiles are driven by a centrally located track which comes into contact with the ground surface, usually snow, over which the snowmobile travels. During operation of the snowmobile, and particularly upon commencing forward travel, the snow engaging portion of the track, moving from a front of the snowmobile to the back, lifts up some of the snow it contacts and then propels or sprays it backwards at a track back location where the track loses contact with the snow covered surface.

As a result of the snow spray effect when the snowmobile commences operation, a pile of snow is usually deposited just behind the position where the back end of snowmobile was located. If the pile is left alone it merely represents a mound of snow in the snow trail. If this pile is traveled over by other snowmobiles it is compacted and eventually forms a mogul or the like. In either case, this one pile of snow creates an unlevel disturbance in the snowmobile trail. Such an unlevel disturbance is sometimes desirable to provide a more challenging snowmobile ride. However, even just one of these disturbances make operating a snowmobile somewhat hazardous given the uneven snow surface. Then, taking a popular snowmobile trail it is evident that over a period of time and with many snowmobiles traveling over the same trail, the snow mound/mogul effect would be multiplied and the destruction to the snowmobile quite significant.

To a somewhat lesser degree, but still significant and more so depending on the snow moisture conditions, during operation of the snowmobile the snow spray is continuously propelled outward and upward from the back of the snowmobile, but not at a constant rate. The amount of snow sprayed depends on the speed of the snowmobile and the snow moisture conditions. Thus, in the ordinary course of operating a snowmobile, simply changing speeds will, regardless of moisture conditions, vary the amount of snow sprayed whereby any positive differential amount will cause a snow mound, and in due course over time a mogul or the like.

One way to deal with the snow mound, moguls and the like is to remove them well after they have formed, i.e. with equipment that is proposed by the prior art devices. Such an approach is commendable, however, it ignores the bigger part of the problem, namely, its creation.

With the prior art devices, although removing the snow mound, moguls and the like solves one problem it often creates another bigger problem. Over a short period of time, employing one of the three non-industrial type devices tends to form a snow trail rut where the existing device scrapes over the snow trail and pushes the loose snow off or out of the sides of the device. As is obvious in geographical locations where there is not a steady supply of new snow or a substantial snow base, such a scraping action displacing the snow trail snow would destroy a snowmobile trail, making it unusable.

These and other types of trail smoothing or grooming devices disclosed in the prior art do not offer the flexibility and inventive features of my Snow-Handling Trail-Grooming Device. As will be described in greater detail hereinafter, the features, combination of features and improvements of the present invention differ from those previously proposed.

SUMMARY OF THE INVENTION

In accordance with the present invention, I have provided a snow-handling trail-grooming device for handling an operating snowmobile's snow spray. The device comprises a snow-handling trial-grooming device including a sled. The sled includes at least one runner member, a sled front end, a sled back end and an open-ended longitudinal cavity therethrough open at opposed longitudinal ends thereof. A tunnel structure is joined with the runner member and is positioned over the open-ended longitudinal cavity. At least one handling-grooming member is joined with the runner member, wherein the handling-grooming member is positioned in an extended direction away from the tunnel structure during snow-handling and trail-grooming.

Still another feature of my invention concerns the snow handling structures comprising a tunnel structure including a tunnel front end, a tunnel back end, a tunnel top portion and a pair of opposed tunnel side portions each joined adjacent the tunnel top portion, and, the tunnel front end pivotally joined to the sled front end; an external deflector plate having a first deflector plate end and a second deflector plate end, the first deflector plate end joined to the operating snowmobile and the second deflector plate end pivotally joined to the pair of runner members at the sled front end and enabling substantially only pivotal vertical movement of the second deflector plate relative to the sled front end, and the external deflector plate being sized and positioned to direct the snowmobile's snow spray down into the open-ended longitudinal cavity Other features and advantages of my invention will become more readily apparent upon reference to the following description when taken in conjunction with the accompanying drawings, which drawings illustrate several embodiments of my invention.

DETAILED DESCRIPTION OF THE PREFERRED EMBODIMENT

Figure 1:
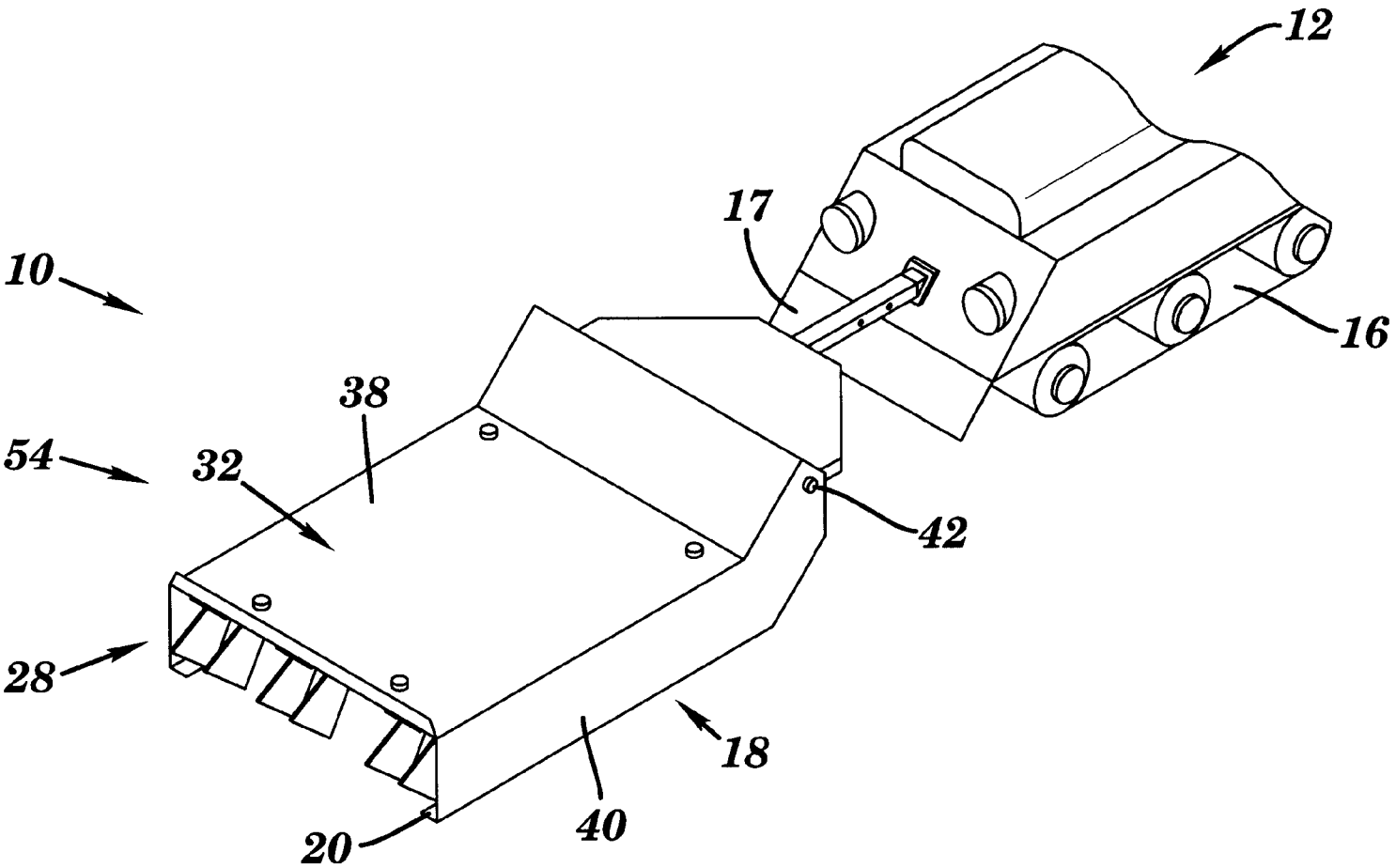
FIG. 1 is a back corner perspective view of my snow-handling trail-grooming device hitched to a snowmobile in accordance with an embodiment of my invention.

Referring now to the drawings, FIGS. 1–6 generally show my snow-handling trail-grooming device 10 connected to a snowmobile 12. The snowmobile, a typical prior art device, particularly includes a ground surface or snow trail engageable snowmobile track 16 (FIG. 1, e.g.).

Figure 2:
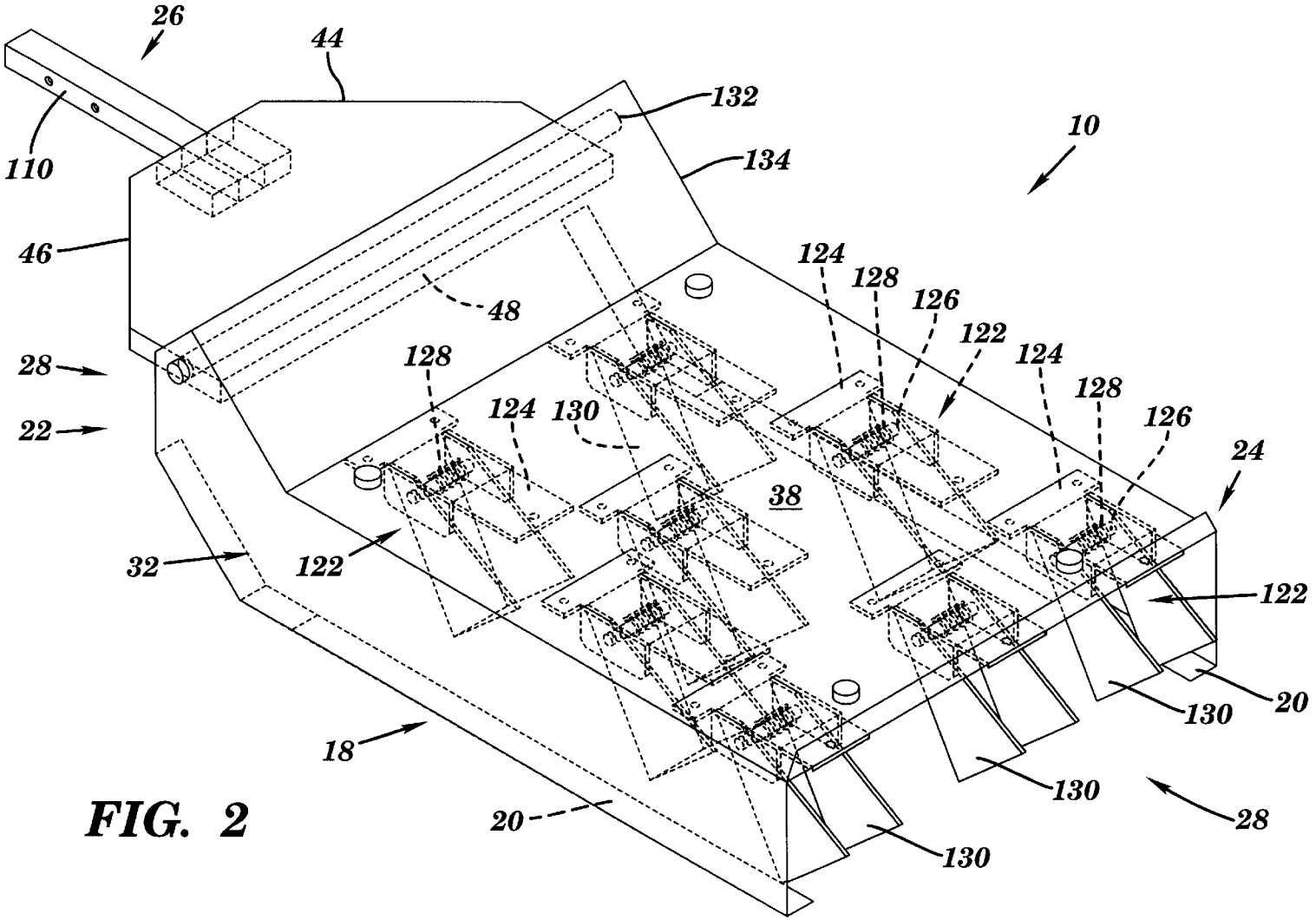
FIG. 2 is a perspective top view of an embodiment of my snow-handling trail-grooming device in accordance with preferred features of my invention, here depicting in phantom the interior view of the invention.
Figure 3:
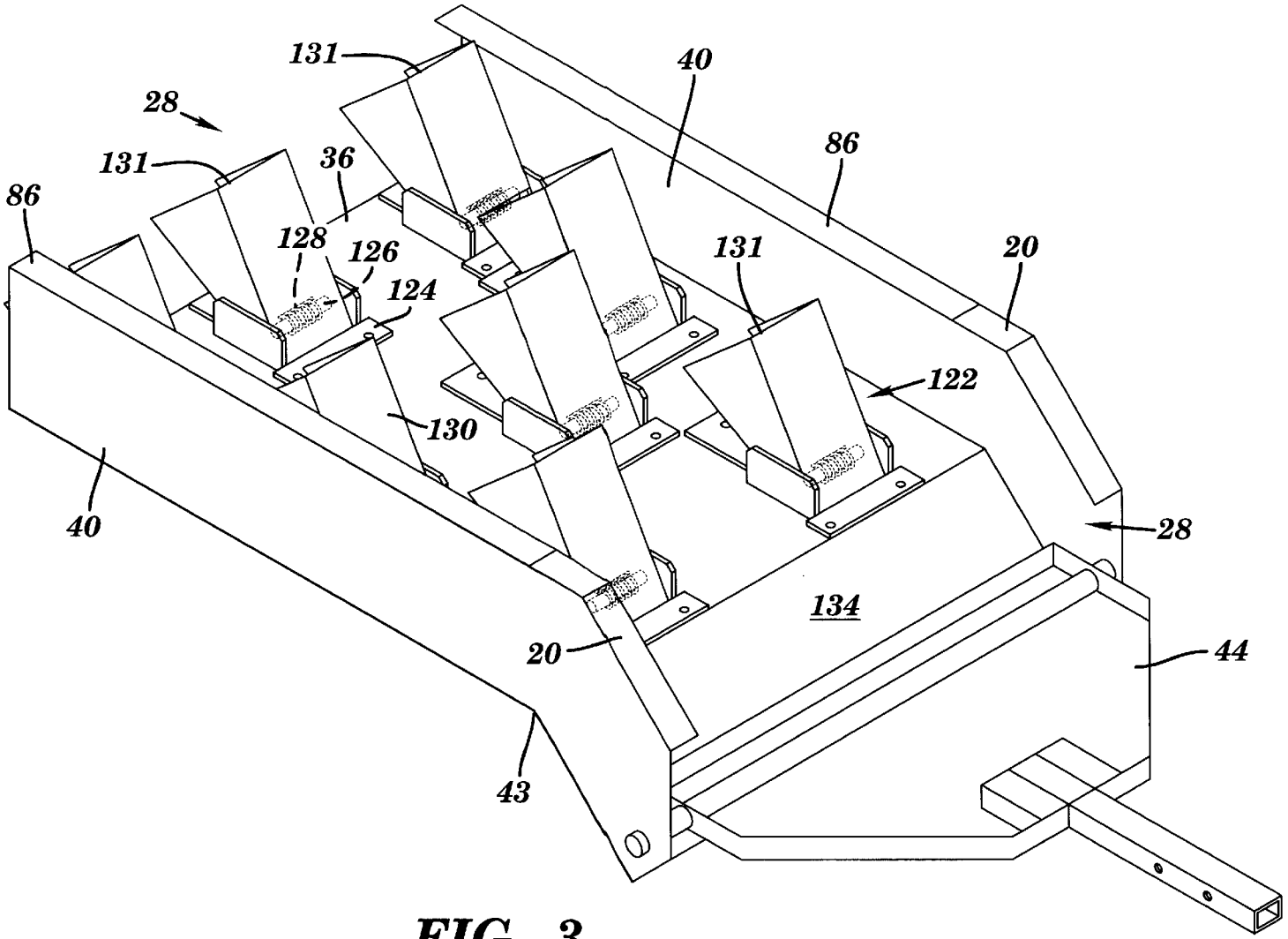
FIG. 3 is a perspective bottom view of FIG. 2, here depicting in phantom certain portions of the invention.
Figure 4:
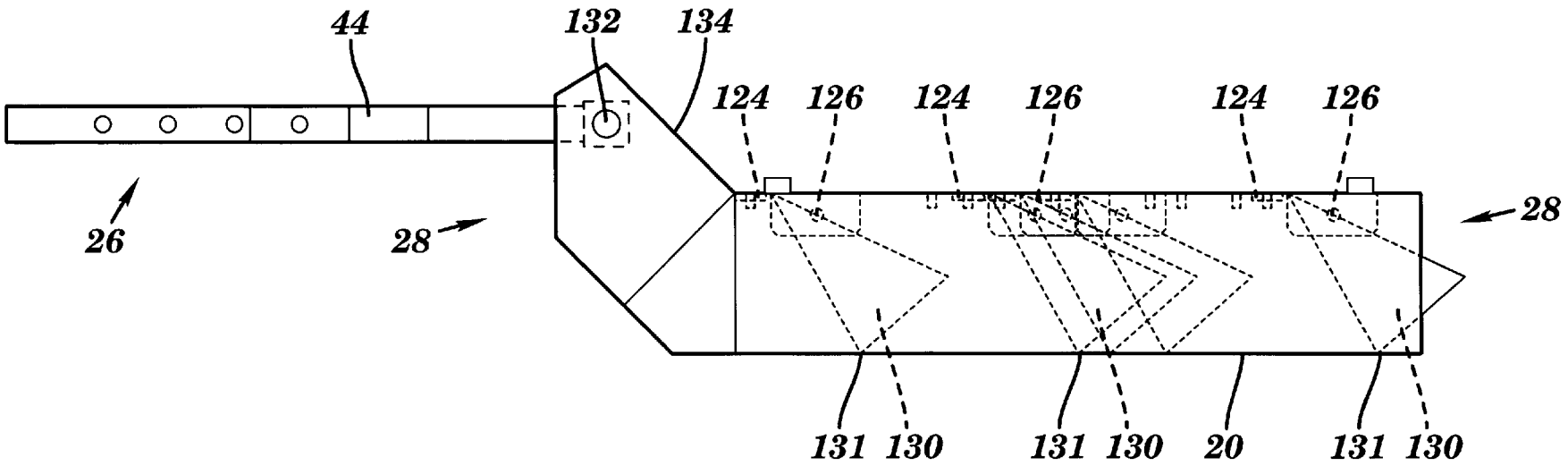
FIG. 4 is a side view of the invention depicted in FIG. 2, also here depicting in phantom certain portions of the invention.
Figure 5:
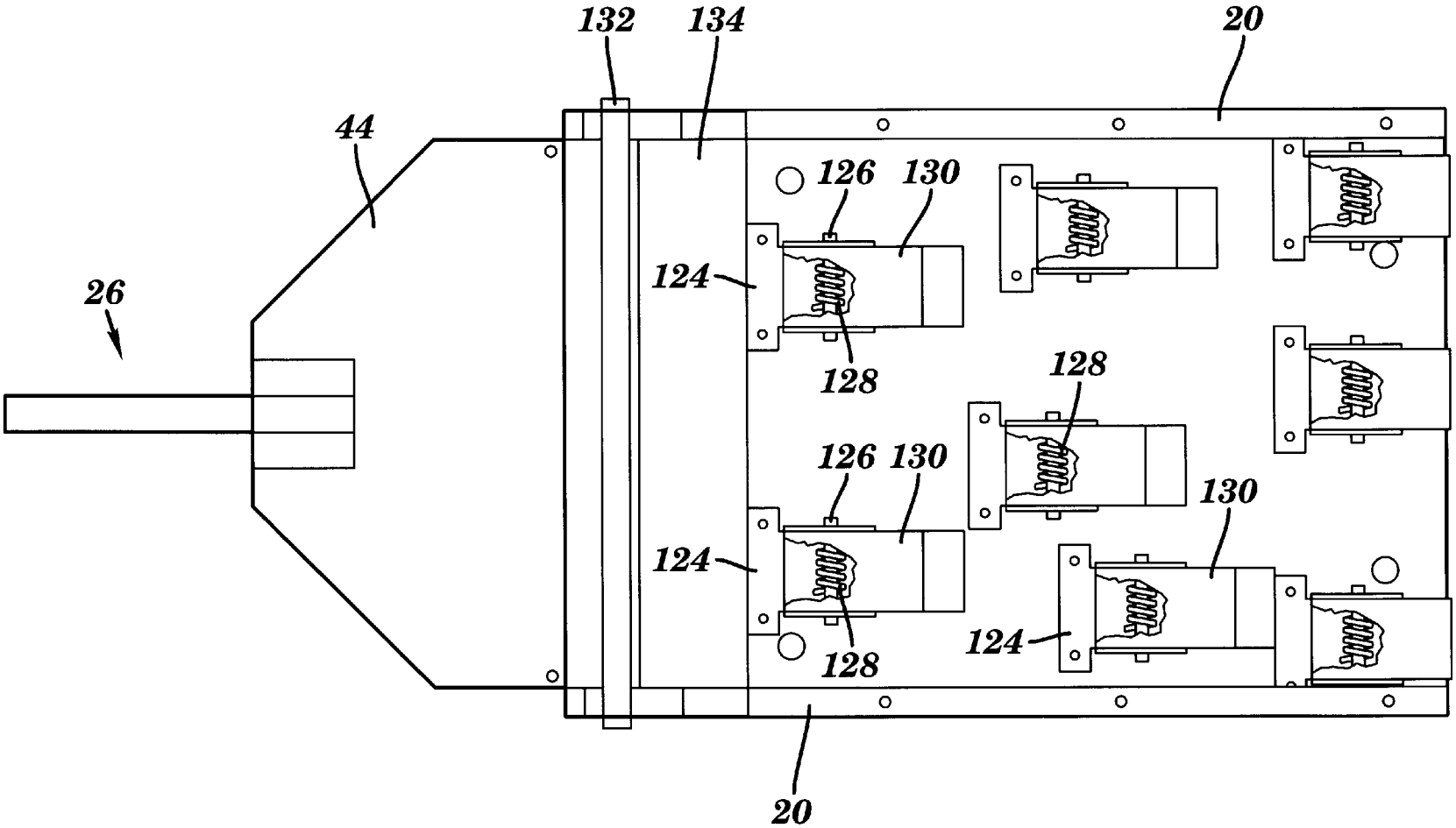
FIG. 5 is a top partial cut away view of the invention depicted in FIG. 2, where the tunnel top portion is partially cut away.

For example, referring to FIGS. 1 and 2, my device 10 comprises a sled 18. The sled 18 includes a pair of runner members 20, a sled front end 22, a sled back end 24 and an open-ended longitudinal cavity 28 extending therethrough and open at opposed longitudinal ends thereof. The runner members are preferably formed integral with the side portion 40 of the tunnel structure. In particular, each runner comprises a lower edge of the respective side portion that is bent over perpendicular to the side portion. Excellent results are obtained when the pair of runner members include replaceable wear pads 86 connectable thereto along a bottom surface of the pair of runner members. In particular, the wears pads are preferably constructed of the material know in the art by the trademark "HYFAX".

Figure 6:
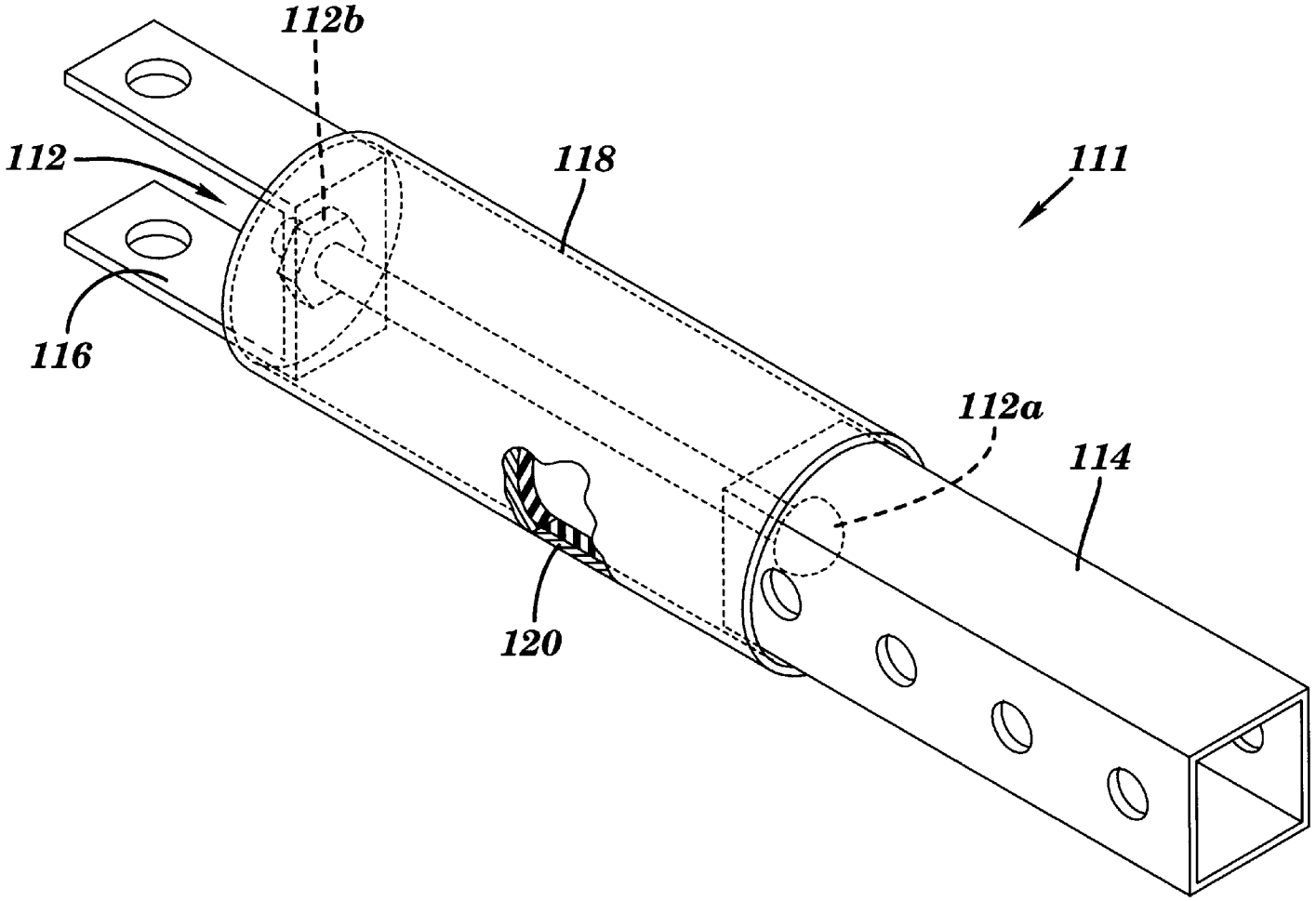
FIG. 6 is a perspective view of a torsion stabilizing tube for use with the various embodiments of my invention disclosed here.

The sled is hitched and unhitched to and from the snowmobile by a hitching or towing assembly 26. Excellent results are obtained when the hitching assembly 26 comprises a towing member 110 joined with the tunnel structure and connectable with the snowmobile (FIG. 6, e.g.). The towing member preferably comprises a torsion stabilizing tube 111. The tube 111 includes a tang tube 114 and a U-shaped hitch connector 116. A bolt 112 is anchored at one end 112*a* (e.g., by welding, forming integral, bolting, etc.) to the tube 114 and at another end 112*b* (e.g., preferably by bolting, or by other means enabling an adjustable relationship) to the connector 116, thereby joining the tube 111 components. The connectors 116 and 114 are preferably not integrally connected, but rather are connected via the bolt 112 but also in combination with the torsion tube 118 (e.g., composed of a rubber or rubber-like material). The tube 118 fictionally engages the circumference of the respective connector 116 and tube 114. Also, the torsion tube 118 preferably has a rigid outer sleeve 120 to maintain the tube's integrity (e.g., a metal shell). In use, the tang tube 114 is connectable to the towing member 110 in sliding relationship with any conventional lock member (e.g., a bolt and nut, padlock, etc.). Then, the hitch connector 116 is joinable with the operating vehicle or snowmobile in a conventional way with a conventional hitching mechanism of the vehicle, similar to that previously discussed. The advantage to the torsion tube 111, for use with any of the sled embodiment disclosed herein, is its ability to absorb torque forces exerted on or by the sled during towing over a surface, such as a snow trail. Further excellent results are obtained when a distance between a back end of the snowmobile track 16 and the sled front end is in the range of three to twelve inches.

Another feature of my invention concerns its ability to handle a snowmobile's snow spray (as the spray is readily known and understood by those skilled in the art as well as the average rider of a snowmobile) and provide a regulated discharge of snow from the back end of the sled when the snowmobile is operating, thereby preventing snow mounds, moguls and the like from forming in the first place on snowmobile trails. Excellent results are obtained towards handling the snow spray and providing a regulated discharge of that snow from the sled when a tunnel structure 32 is utilized with the sled. In particular, the tunnel structure includes a tunnel front end 43, a tunnel back end 36, a tunnel top portion 38, a pair of opposed tunnel side portions 40 each connected adjacent the tunnel top portion and the tunnel structure being sized and positioned to provide a regulated discharge of snow from the back end of the sled when the snowmobile is operating. The tunnel structure is preferably fixed relative to the runner members. Additionally, the tunnel structure may comprise a unitary construction of a single piece of plate metal. From commercial and aesthetics considerations, the tunnel top portion 38 provides a place for logos and graphics and the like for advertising or merely aesthetic purposes.

As explained, snow conditions permitting, maintaining the tunnel in the tunnel collapsed position enables the best regulated snow discharge. Also, should too much snow accumulate underneath the tunnel in the open-ended longitudinal cavity regardless of tunnel positioning, then the whole sled would tend to lift off of the ground to enable a discharge of snow out the bottom portion of the sled until an equilibrium is reached and the weight of the sled (which is quite light weight to enable one person to easily lift and transport my invention) forces it back into contact with the snow trail surface. Although this is not the preferred way to regulate snow discharge, it is a backup way that still surpasses anything offered by prior art devices. It should also be apparent that the regulated discharge structures of my invention serve to return the snowmobile trail snow that is sprayed up by the snowmobile track back to its relative positioning in the center of the snowmobile trail for continued use by other snowmobiles, and not off to either side thereby forming a trench in the trail over time and continued use.

To aid in handling or capturing the snowmobile's snow spray, excellent result are obtained when my invention further includes an external deflector plate 44 having a first deflector plate end 46 and a second deflector plate end 48. The first deflector plate end is connected to the towing assembly 26, although it should be understood that any hitching structure could be utilized whereby the sled is connected to the snowmobile for towing behind it. Ideally, the second deflector plate end is pivotally connected to the pair of runner members 20 at the sled front end, and preferably enabling substantially only vertical movement relative thereto and a limited range of such movement. It is preferred that the deflector plate 44 be pivotally connected to the sled by a rod 132 extending through the tunnel structure side portions and a portion of the external deflector plate and thereby joining the two together. The deflector plate rode 132 may be maintained in position by a conventional nut and bolt type relationship, or cotter pin or the like. Next, the external deflector plate 44 should be sized and positioned to direct the snowmobile's snow spray down into the open-ended longitudinal cavity.

In operation of the snowmobile, the snow spray is propelled upward and backward from the track 16 where it first contacts the snowmobile deflector plate 17, if one exists. Then, the snow spray impacts the external deflector plate which preferably directs a majority of the snowmobile's snow spray down into the open-ended longitudinal cavity. Next, snow accumulates in and discharges from the open-ended longitudinal cavity when the snowmobile is operating thereby providing a regulated discharge of snow that does not create snow mounds, moguls and the like which tend to form over time if my device 10 is not towed behind the snowmobile.

Another feature of the device 10 comprises the handling-grooming members 122, see for example FIGS. 2–5. More particularly, the handling-grooming members 122 serve to cut and smooth a snowmobile trail affected by snow mounds, moguls and the like, when the sled is pulled behind the operating snowmobile, as well as handling a snowmobile's snow spray and assisting in providing a regulated discharge of snow from the sled when the snowmobile is operating.

The handling-grooming members 122 are preferably positioned in an extended direction away from the tunnel structure during snow-handling and trail-grooming. For example, this can be achieved through use of a plate 124 which is rigidly connected to the tunnel structure, by use of conventional bolts or screws for example. Then, a paddle 130, preferably comprising a triangular U-shaped member, is pivotally attached to the plate 124 via pivot rod 126. In particular, the paddle 130 is closed at a front edge facing towards the snowmobile and open at its back edge facing away from the snowmobile, and thus hollow throughout its interior. The pivot rod 126 is maintained in place by any conventional means, such as a cotter pin or a nut and bolt type relationship.

A force is exerted upon the paddle 130 to position it in the extended downward direction. For example, such a force could comprise simply the weight of the paddle itself, but is preferably provided by a spring, namely, a torsion spring 128 (e.g., a conventional single coil torsion spring). When the paddle 130 is in the extended direction away from the tunnel structure, its lowermost edge 131 (FIG. 4, e.g.) preferably extends no further than a plane co-extensive with the pair of runner members 20, similar to the cutting blade(s) 68 discussed previously.

In operation, when the sled is pulled over a snow trail the paddle(s) 130 are preferably positionable between the extended position away from the tunnel structure and a retracted position closer to the tunnel structure. In this way, the paddle(s) are preferably continuously forced into the extended position until impacted by a fixed or massive structure, such as a rock, tree limb or part, or other fixed obstruction in a snow trail, which causes the paddle 130 to retract upwards rather than catch and hold on the obstruction. Also, different forces may be desired for the paddle, depending on use for the sled, snow conditions or the like. Such different forces would be obtained by conventional means, such as adjusting the weight of the paddle or the spring force.

The device 10 may further include a deflector portion 134, which assists the deflector plate 44, as well as the handling-grooming members 122, in regulating the discharge of snow from the operating snowmobile. The plate 134 also can serve as an internal deflector plate to further deflect the snow spray downwardly to better regulate the discharge of snow from the sled.

All components for this embodiment are preferably constructed out of a metal of suitable strength, as desired and conventionally known in the art, and preferably a stainless steel or other metal or material which is water corrosive resistant. As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

I claim:

1. A snow-handing trail-grooming device comprising:

a sled including at least one runner member, a sled front end, a sled back end and an open-ended longitudinal cavity therethrough open at opposed longitudinal ends thereof;

a tunnel structure joined with the runner member and positioned over the open-ended longitudinal cavity; and at least one handling-grooming member joined with the runner member and positioned under the tunnel structure, wherein the handling-grooming member is resiliently positionable between an extended position away from the tunnel structure and a retracted position adjacent the tunnel structure and is resiliently forced into the extended position during snow-handling and trail-grooming.

2. The device of claim 1, wherein the tunnel structure comprises a unitary construction including a tunnel front end, a tunnel back end, a tunnel top portion and a pair of opposed tunnel side portions each connected adjacent the tunnel top portion.

3. The device of claim 1, further comprising an external deflector plate joined with the tunnel structure at the sled front end and the external deflector plate being sized and positioned to direct a snowmobile's snow spray down into the open-ended longitudinal cavity.

4. The device of claim 3, further comprising an internal deflector plate positioned for further deflecting the snowmobile's snow spray downwardly.

5. The device of claim 1, further comprising deflector plate positioned for deflecting a snowmobile's snow spray downwardly.

6. The device of claim 1, wherein the tunnel structure is fixedly positioned relative to the at least one runner member.

7. The device of claim 1, wherein the at least one runner member includes a replaceable wear pad connectable thereto along a bottom surface of the at least one runner member.

8. The device of claim 1, in combination with a plurality of handling-grooming members, wherein each member of the plurality of handling-grooming members comprises the at least one handling-grooming member.

9. The device of claim 1, wherein at least one handling-grooming member is positionable between the extended position and a retracted position, relative to the tunnel structure.

10. The device of claim 1, further comprising a towing member joined with the tunnel structure and connectable with a snowmobile.

11. The device of claim 10, wherein the towing member comprises a torsion stabilizing tube.

12. The device of claim 1, wherein the handling-grooming member is resiliently forced into the extended position by a member from the group consisting of a weight of the handling-grooming member itself or a resilient forcing element acting upon the handling-grooming member.

* * * * *